US011353899B2

(12) United States Patent
Matsubara et al.

(10) Patent No.: US 11,353,899 B2
(45) Date of Patent: Jun. 7, 2022

(54) CONSTANT VOLTAGE DEVICE

(71) Applicant: KABUSHIKI KAISHA TOKAI-RIKA-DENKI-SEISAKUSHO, Aichi-ken (JP)

(72) Inventors: Junichi Matsubara, Aichi-ken (JP); Koji Saito, Aichi-ken (JP)

(73) Assignee: KABUSHIKI KAISHA TOKAI-RIKA-DENKI-SEISAKUSHO, Aichi-Ken (JP)

( * ) Notice: Subject to any disclaimer, the term of this patent is extended or adjusted under 35 U.S.C. 154(b) by 0 days.

(21) Appl. No.: 17/228,995

(22) Filed: Apr. 13, 2021

(65) Prior Publication Data

US 2021/0325921 A1 Oct. 21, 2021

(30) Foreign Application Priority Data

Apr. 16, 2020 (JP) ..... JP2020-073693

(51) Int. Cl.
*G05F 1/46* (2006.01)
*G05F 3/24* (2006.01)

(52) U.S. Cl.
CPC ..... *G05F 1/461* (2013.01); *G05F 1/468* (2013.01); *G05F 3/24* (2013.01)

(58) Field of Classification Search
CPC ..... G05F 1/461; G05F 1/468; G05F 3/24
See application file for complete search history.

(56) References Cited

U.S. PATENT DOCUMENTS

| | | | | |
|---|---|---|---|---|
| 10,199,932 | B1 * | 2/2019 | Hastings | G05F 1/468 |
| 10,228,818 | B2 * | 3/2019 | Vandermolen | G06F 16/93 |
| 2012/0206058 | A1 * | 8/2012 | Hirano | H05B 45/3725 315/245 |
| 2019/0146532 | A1 * | 5/2019 | Ballarin | H05B 45/382 323/283 |
| 2021/0124380 | A1 * | 4/2021 | Fort | G05F 1/461 |
| 2021/0191441 | A1 * | 6/2021 | Kagimoto | G05F 1/575 |

FOREIGN PATENT DOCUMENTS

JP 2007219856 A 8/2007

* cited by examiner

*Primary Examiner* — Kyle J Moody
*Assistant Examiner* — Lakaisha Jackson
(74) *Attorney, Agent, or Firm* — Dority & Manning, P.A.

(57) ABSTRACT

A constant voltage device include a diode; a switch including one terminal connected to a ground potential and another terminal connected both to an anode terminal of the diode and to a drain of a PMOS transistor having a source applied with a power source voltage; a voltage generation circuit configured to generate a voltage of a predetermined magnitude; and a differential amplifier that includes a non-inverting input terminal to which both a cathode terminal of the diode and an output terminal of the voltage generation circuit are connected, and that is configured to change a supply route of a reference voltage applied to the non-inverting input terminal according to a state of the switch. The voltage generation circuit is configured to employ an output voltage based on the reference voltage and amplified by the differential amplifier to generate the reference voltage.

4 Claims, 4 Drawing Sheets

CONSTANT VOLTAGE DEVICE

CROSS-REFERENCE TO RELATED APPLICATION

This application claims priority under 35 USC 119 from Japanese Patent Application No. 2020-073693 filed Apr. 16, 2020, the disclosure of which is incorporated by reference herein.

BACKGROUND

Technical Field

The present disclosure relates to a constant voltage device, and in particular to technology beneficially applied to a linear constant voltage device.

Related Art

Japanese Patent Application Laid-Open (JP-A) No. 2007-219856 proposes a related linear constant voltage device.

FIG. 4 illustrates an example of a device configuration employed in such a related constant voltage device employing a linear approach.

A related constant voltage device 100 includes, for example, a startup circuit U1, a Band Gap Reference (BGR) circuit U2, a differential amplifier AMP, a PMOS transistor Tr1, a resistor R1, and a resistor R2.

Application of a power source voltage VBB results in a VREG voltage being supplied to the BGR circuit U2 through the startup circuit U1. The BGR circuit U2 input with the VREG voltage as an input voltage generates a VBGR voltage that serves as a reference voltage of the constant voltage device 100.

An amplification circuit, which is configured by the differential amplifier AMP, the PMOS transistor Tr1, and the resistor R1 and resistor R2 forming a feedback circuit, takes the VBGR voltage generated by the BGR circuit U2 as a reference voltage and outputs an output voltage VCC.

However, there is acknowledged to be some dependency in the VREG voltage of the constant voltage device 100 illustrated in FIG. 4 to the power source voltage VBB, i.e. the VREG voltage changes to follow changes to the power source voltage VBB. Accordingly, dependency to the power source voltage VBB also affects the VBGR voltage generated in the BGR circuit U2 that takes the VREG voltage as an input, with the result that the output voltage VCC also has dependency to the power source voltage VBB.

This dependency to the power source voltage VBB of the output voltage VCC is undesirable when the constant voltage device 100 is employed as a constant voltage source.

SUMMARY

In consideration of the above circumstances, the present disclosure provides a constant voltage device able to make an output voltage less dependent on a power source voltage than in cases in which a reference voltage is generated from a voltage dependent on the power source voltage.

A constant voltage device according to a first aspect includes a diode, a switch, a voltage generation circuit, and a differential amplifier. The switch includes one terminal connected to a ground potential and another terminal connected both to an anode terminal of the diode and to a drain of a PMOS transistor having a source is applied with a power source voltage. The voltage generation circuit is configured to generate a voltage of a predetermined magnitude. The differential amplifier includes a non-inverting input terminal to which both a cathode terminal of the diode and an output terminal of the voltage generation circuit are connected, and is configured to change a supply route of a reference voltage applied to the non-inverting input terminal according to a state of the switch. The voltage generation circuit is configured to employ an output voltage based on the reference voltage and amplified by the differential amplifier to generate the reference voltage.

In the constant voltage device according to the first aspect, the output voltage of the constant voltage device is employed as feedback to the voltage generation circuit when the reference voltage is generated by the voltage generation circuit. This accordingly enables the dependency of the reference voltage to the power supply voltage to be reduced in comparison to cases in which the reference voltage is generated by supplying a voltage dependent on the power supply voltage to a voltage generation circuit. The dependency to the power supply voltage of the output voltage generated from the reference voltage can accordingly also be reduced.

In a constant voltage device according to a second aspect, the diode is configured by a p-n junction between a back gate terminal and a drain terminal of an NMOS transistor formed in an active layer present on a support substrate with an insulation layer interposed between the active layer and the support substrate.

A diode provided as a discrete component has a greater power loss than a diode utilizing an NMOS transistor. Thus in the constant voltage device of the second aspect, by using the NMOS transistor as a diode, the efficiency of the constant voltage device can be raised compared to a constant voltage device employing a discrete component diode.

In a constant voltage device according to a third aspect, a periphery of the NMOS transistor is surrounded by an insulator so as to electrically insulate the diode from another element formed in the active layer.

In the constant voltage device of the third aspect, the NMOS transistor is electrically insulated from other elements even in cases in which other elements are formed in the active layer other than the NMOS transistor utilized as a diode. The back gate terminal of the NMOS transistor is accordingly utilized as an anode terminal of the diode, and electrical effects to other elements can be avoided even if a voltage other than a ground potential is applied to the back gate terminal.

A constant voltage device according to a fourth aspect further includes a control circuit to control the switch. The switch is controlled such that in cases in which the output voltage is below a prescribed voltage, the reference voltage is supplied to the non-inverting input terminal of the differential amplifier both from the diode and from the voltage generation circuit. The switch is controlled such that in cases in which the output voltage has reached the prescribed voltage or greater, the reference voltage is supplied to the non-inverting input terminal of the differential amplifier from the voltage generation circuit.

In the constant voltage device of the fourth aspect, after the output voltage has reached the prescribed voltage, the voltage from the voltage generation circuit that is not dependent on the power supply voltage is input alone as the reference voltage to the non-inverting input terminal of the differential amplifier. The output voltage output from the output terminal of the constant voltage device is accordingly also a voltage that is not dependent on the power supply voltage.

BRIEF DESCRIPTION OF THE DRAWINGS

Exemplary embodiments of the present invention will be described in detail based on the following figures, wherein.

DETAILED DESCRIPTION

Figure 1:
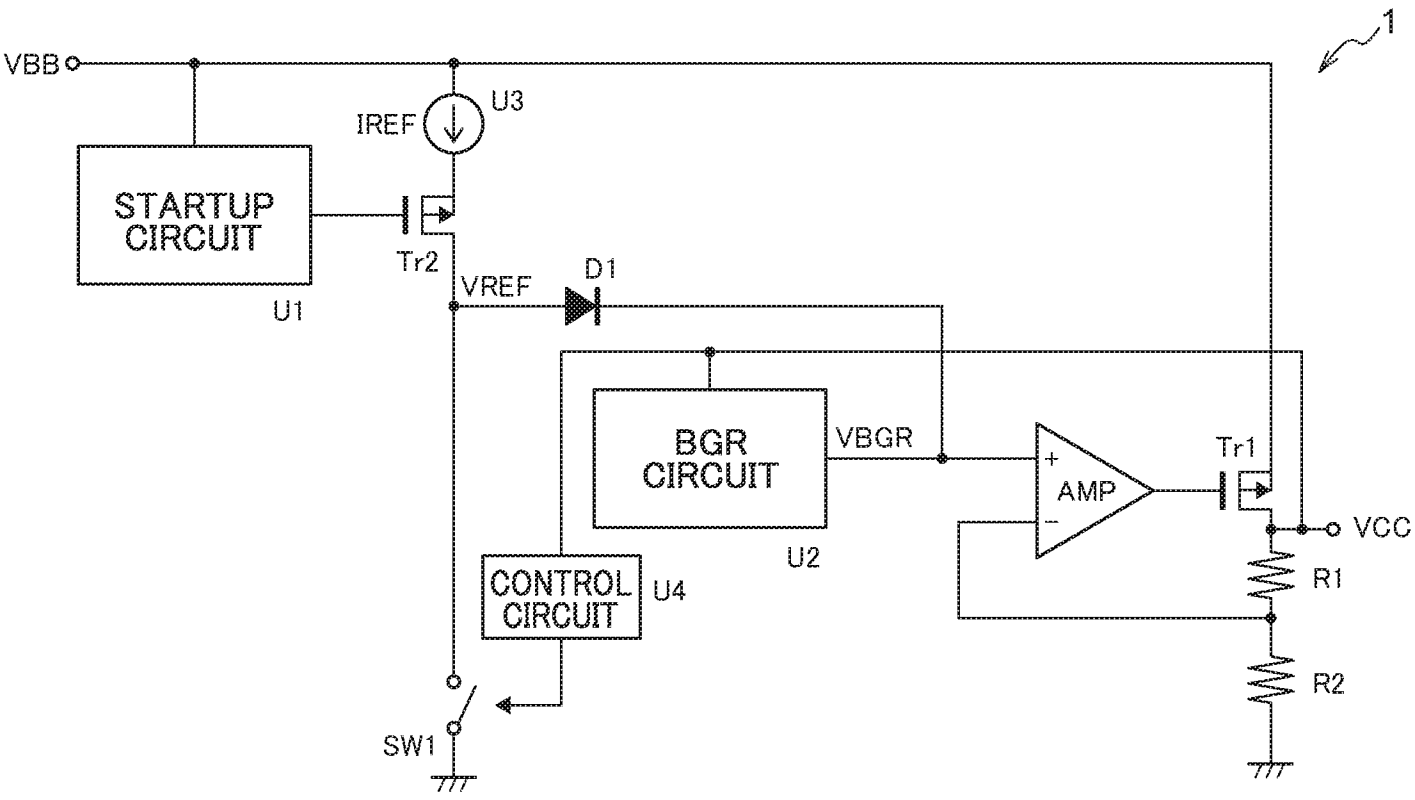
FIG. 1 is a diagram illustrating an example of a device configuration of a constant voltage device.

Explanation follows regarding an exemplary embodiment, with reference to the drawings. Note that same configuration elements are allocated the same reference numerals in all drawings, and duplicate explanation thereof will be omitted.

Connections of Constant Voltage Circuit

FIG. 1 is a diagram illustrating an example of device configuration of a constant voltage device 1 according to the present exemplary embodiment. The constant voltage device 1 includes a startup circuit U1, a BGR circuit U2, a constant current source U3, a switch SW1, a differential amplifier AMP, a resistor R1, a resistor R2, PMOS transistors Tr1, Tr2, and a diode D1. Note that transistors in the present exemplary embodiment specifically refer to Metal-Oxide-Semiconductor Field Effect Transistors (MOSFET).

A power source voltage VBB employed by the constant voltage device 1 is supplied to the startup circuit U1, and the power source voltage VBB is monitored until it rises to the voltage needed for operation of the constant voltage device 1. The startup circuit U1 starts to supply a voltage from an output terminal in cases in which the power source voltage VBB has risen to a predetermined voltage (starting voltage).

The output terminal of the startup circuit U1 is connected to a gate terminal of the PMOS transistor Tr2, and an output terminal of the constant current source U3, which has one end connected to the power source voltage VBB, is connected to a source terminal of the PMOS transistor Tr2. The switch SW1, which has one end connected to a ground potential, and an anode terminal of the diode D1, are connected to a drain terminal of the PMOS transistor Tr2. For the purposes of explanation of the present exemplary embodiment the ground potential is taken as being 0V.

A cathode terminal of the diode D1 is connected to a non-inverting input terminal of the differential amplifier AMP, and an output terminal of the differential amplifier AMP is connected to a gate terminal of the PMOS transistor Tr1.

A source terminal of the PMOS transistor Tr1 is connected to the power source voltage VBB, and a drain terminal of the PMOS transistor Tr1 is connected to an output terminal that outputs an output voltage VCC generated by the constant voltage device 1, and to one end of the resistor R1.

The other end of the resistor R1 is connected in series to the resistor R2, which has one end connected to the ground potential. A connection point between the resistor R1 and the resistor R2 is connected to an inverting input terminal of the differential amplifier AMP. Namely, the resistor R1 and the resistor R2 form a feedback circuit to provide a divided voltage (feedback voltage), which is the output voltage VCC divided according to a ratio (voltage dividing ratio) between the resistor R1 and the resistor R2, as negative feedback to the differential amplifier AMP. The resistor R1 and the resistor R2 are examples of feedback resistors.

The output terminal of the constant voltage device 1 is connected to the BGR circuit U2, such that the output voltage VCC is supplied to the BGR circuit U2.

The BGR circuit U2 uses the output voltage VCC as an input voltage to generate a VBGR voltage. An output terminal of the BGR circuit U2 is connected to the non-inverting input terminal of the differential amplifier AMP, and the VBGR voltage is employed as a reference voltage of the constant voltage device 1.

The BGR circuit U2 is an example of a voltage generation circuit, and for example employs a band gap energy of silicon to generate the VBGR voltage of predetermined magnitude. More specifically, the BGR circuit U2 utilizes the fact that there is an inverse relationship between the temperature coefficient of silicon and the temperature coefficient of the band gap voltage to generate a VBGR voltage from which voltage change due to temperature is eliminated.

The constant voltage device 1 uses the feedback circuit to divide the output voltage VCC, uses the differential amplifier AMP to compare the reference voltage against the feedback voltage, and to control the PMOS transistor Tr1 based on the difference therebetween so as to adjust the magnitude of the output voltage VCC. Namely, an amplification circuit configured by the differential amplifier AMP, the PMOS transistor Tr1, and feedback circuit outputs the output voltage VCC obtained by taking the reference voltage input to the differential amplifier AMP, and amplifying the input reference voltage by a voltage dividing ratio ((R1+R2)/R2) of the feedback resistors.

The output terminal of the constant voltage device 1 is also connected to a control circuit U4, such that the output voltage VCC is supplied to the control circuit U4.

The control circuit U4 monitors the output voltage VCC and controls the state of the switch SW1 in response to the magnitude of the output voltage VCC. The states of the switch SW1 include an ON state and an OFF state. The ON state of the switch SW1 is when the switch SW1 is closed (shorted) such that the anode terminal of the diode D1 becomes the ground potential. The OFF state of the switch SW1 is when the switch SW1 is open such that the anode terminal of the diode D1 is not the ground potential.

Operation and Advantageous Effects of the Present Exemplary Embodiment

Next, explanation follows regarding operation of the constant voltage device 1 illustrated in FIG. 1. Note that the control circuit U4 is a circuit in which control is performed in advance so as to place the switch SW1 in the OFF state in a state in which the power source voltage VBB is not being supplied to the constant voltage device 1.

As already described, the output terminal of the startup circuit U1 is connected to the gate terminal of the PMOS transistor Tr2. Thus a voltage is applied to the gate terminal of the PMOS transistor Tr2 when the power source voltage VBB is supplied to the constant voltage device 1 and the power source voltage VBB has reached the starting voltage.

In cases in which the PMOS transistor Tr2 is in an ON state, a current IREF flows from the source terminal of the PMOS transistor Tr2 toward the drain terminal thereof, and a VREF voltage is generated at the drain of the PMOS transistor Tr2.

The VREF voltage is input, via the diode D1, as a reference voltage to the non-inverting input terminal of the differential amplifier AMP.

In the amplification circuit including the differential amplifier AMP, when the reference voltage is input into the non-inverting input terminal of the differential amplifier AMP, the output voltage VCC, which is obtained by amplifying the reference voltage at an amplification ratio set by the voltage dividing ratio of the feedback resistors, is output from the output terminal of the constant voltage device 1.

The output voltage VCC is supplied to the BGR circuit U2, and the VBGR voltage is generated by the BGR circuit U2. The VBGR voltage is input to the non-inverting input terminal of the differential amplifier AMP as a reference voltage, together with the VREF voltage supplied from the diode D1.

The switch SW1 is set so as to be switched from the OFF state to the ON state by the control circuit U4 in cases in which the output voltage VCC, which rises accompanying a rise in the power source voltage VBB, has reached an output voltage VCC of a prescribed voltage or greater. The drain of the PMOS transistor Tr2 is grounded when the switch SW1 has been placed in the ON state, and so the VREF voltage accordingly becomes the ground potential. The voltage input to the non-inverting input terminal of the differential amplifier AMP via the diode D1 accordingly becomes 0V.

Subsequently, as long as the switch SW1 remains in the ON state, the VBGR voltage generated in the BGR circuit U2 is input alone as a reference voltage to the non-inverting input terminal of the differential amplifier AMP.

Note that the prescribed voltage refers to a magnitude of voltage that, when this voltage is attained, constricts an amplitude of change in the VBGR voltage generated by the BGR circuit U2 to within a predetermined range. Such constriction of an amplitude of change in voltage to within a predetermined range such that the voltage may be considered constant is referred to as "stabilizing the voltage".

Subsequent to the power source voltage VBB rising and the output voltage VCC reaching the prescribed voltage, the stabilized VBGR voltage from the BGR circuit U2 is input alone as a reference voltage to the non-inverting input terminal of the differential amplifier AMP. Accompanying this, a stable output voltage VCC is output from the output terminal of the constant voltage device 1.

Namely, in cases in which the output voltage VCC is below the prescribed voltage, the control circuit U4 controls the switch SW1 to the OFF state such that reference voltages from the diode D1 and from the BGR circuit U2 are supplied to the non-inverting input terminal of the differential amplifier AMP.

On the other hand, in cases in which the power source voltage VBB has reached the prescribed voltage or greater, the control circuit U4 controls the switch SW1 to the ON state such that the VREF voltage becomes the ground potential. When this is performed, the VBGR voltage from the BGR circuit U2 alone is supplied as a reference voltage to the non-inverting input terminal of the differential amplifier AMP.

In the constant voltage device 1, switching the state of the switch SW1 according to the magnitude of the output voltage VCC in this manner changes the supply route of reference voltage applied to the non-inverting input terminal of the differential amplifier AMP.

Due to adopting such control, the BGR circuit U2 generates a reference voltage that is not dependent on the power source voltage VBB, with the result that the output voltage VCC generated from the reference voltage is similarly a voltage not dependent on the power source voltage VBB. Note that reference to the reference voltage and the output voltage VCC not being dependent on the power source voltage VBB means that the reference voltage and the output voltage VCC remain stable even to movements in the power source voltage VBB.

Figure 2:
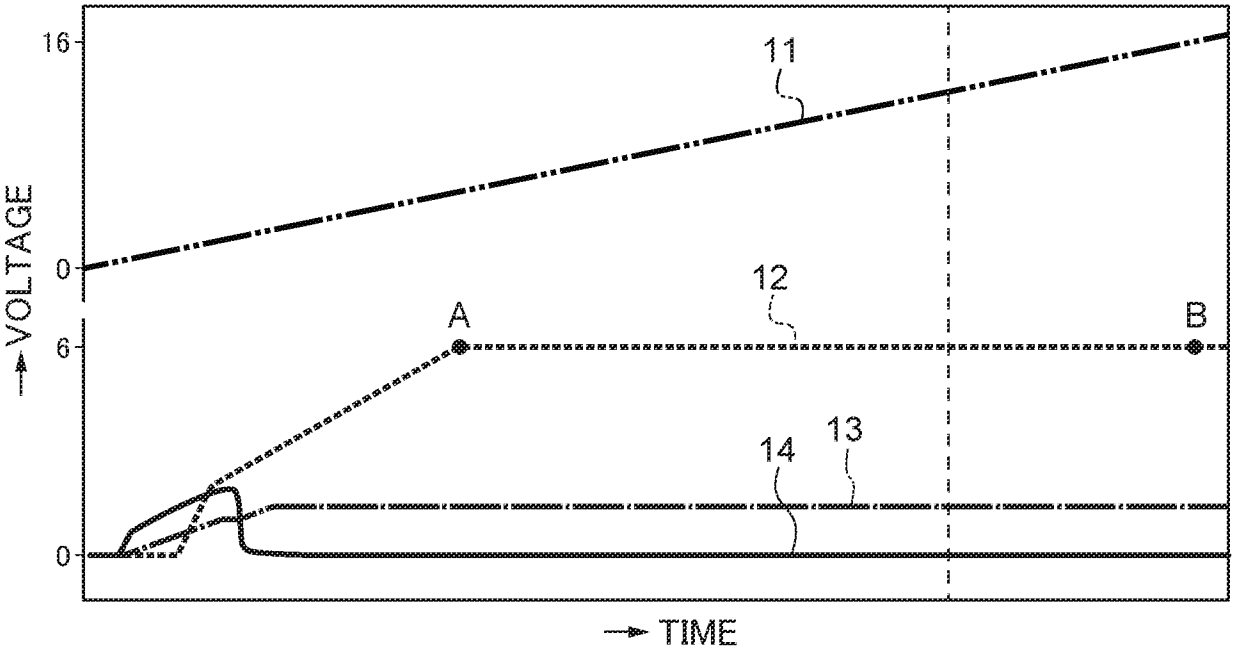
FIG. 2 is a graph illustrating an example of changes in respective voltages in a constant voltage device as a power source voltage is changed.

FIG. 2 is a graph illustrating an example of changes in the respective voltages in the constant voltage device 1 in a case in which the power source voltage VBB input to the constant voltage device 1 changes from 0V to 16V.

The horizontal axis in FIG. 2 represents time, and the vertical axis in FIG. 2 represents voltage. The waveform 11 represents change in the power source voltage VBB, and the waveform 12 represents change in the output voltage VCC. The waveform 13 represents change in the VBGR voltage, and the waveform 14 represents change in the VREF voltage.

In the graph of FIG. 2, the waveform 11 of the power source voltage VBB is illustrated shifted in the vertical axis direction from the respective waveforms 12 to 14 of the output voltage VCC, the VBGR voltage, and the VREF voltage, such that changes in the plural waveforms 11 to 14 are not confused by intersections therebetween. The vertical axis of FIG. 2 accordingly shows both a scale for the power source voltage VBB and a separate, common scale for the output voltage VCC, the VBGR voltage, and the VREF voltage.

As illustrated in FIG. 2, since the switch SW1 is in the OFF state immediately after the power source voltage VBB is applied to the constant voltage device 1, the VREF voltage also rises accompanying the rise in the power source voltage VBB. The reference voltage therefore rises.

When the reference voltage reaches a minimum input voltage for the differential amplifier AMP, the output voltage VCC is output from the amplification circuit, and accompanying this the VBGR voltage starts to be supplied from the BGR circuit U2. While this occurs the power source voltage VBB also rises, there is a mutual rise in the voltages of the reference voltage and the output voltage VCC, and the switch SW1 is set so as to be in the ON state when the output voltage VCC reaches the prescribed voltage or greater. The VREF voltage accordingly becomes 0V, after which the VBGR voltage supplied from the BGR circuit U2 is applied as the reference voltage to the non-inverting input terminal of the differential amplifier AMP.

As the power source voltage VBB continues to rise thereafter, the VBGR voltage generated by the BGR circuit U2 begins to stabilize, accompanying which the output voltage VCC also stabilizes, and the constant voltage device 1 outputs the output voltage VCC corresponding to a rated voltage.

As an example, at the timing of point A at which the power source voltage VBB reaches 6V in FIG. 2, the output voltage VCC is 5.0195V and the reference voltage is 1.2044V. At point B at which the power source voltage VBB has reached 16V, the output voltage VCC is 5.0202V, and the reference voltage is 1.2045V. Namely, the amplitude of change in the output voltage VCC from point A to point B is 0.7 mV, and the amplitude of change in the reference voltage between point A and point B is 0.1 mV. It is apparent that despite there being an approximately 2.67-fold increase in the power source voltage VBB between point A and point B, the amplitudes of change in the output voltage VCC and the reference voltage are constricted to within a given range, and the output voltage VCC and the reference voltage are stable.

Figure 4:
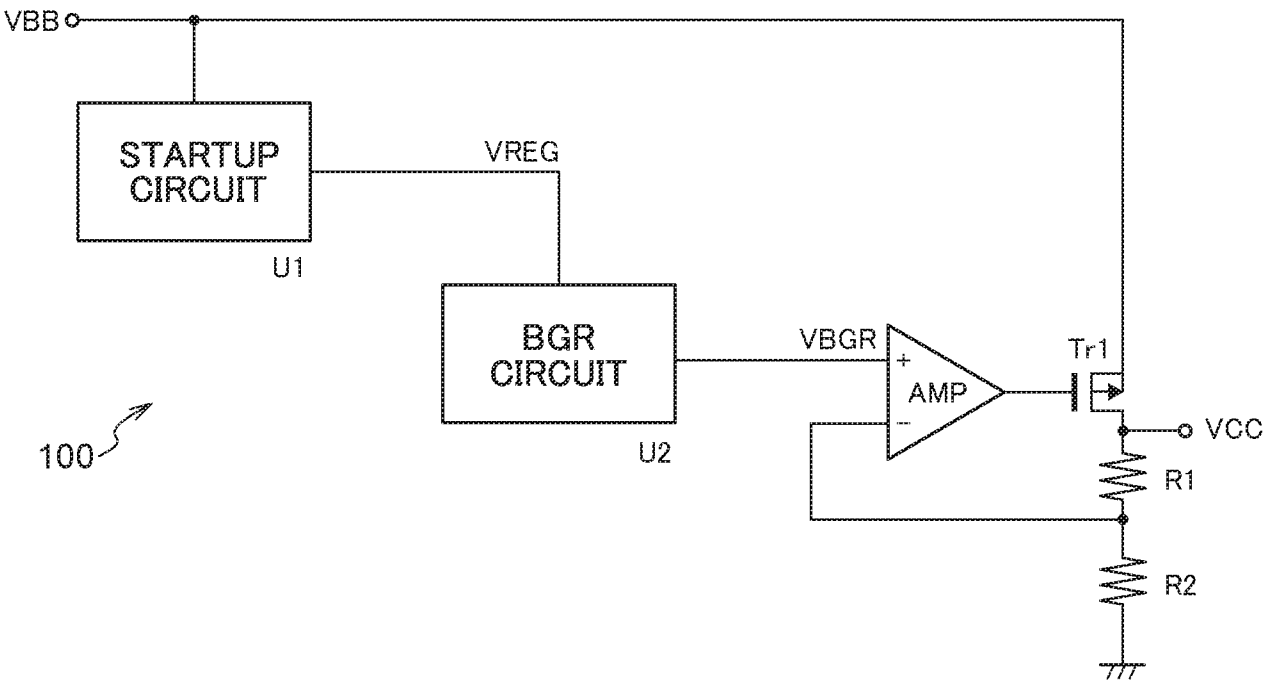
FIG. 4 is a diagram illustrating an example of a device configuration of a related constant voltage device.

In the related constant voltage device 100 illustrated in FIG. 4, the VREG voltage also rises accompanying the rise in the power source voltage VBB. The voltage withstand performance of the BGR circuit U2 therefore needs to be designed to accommodate the maximum value of the power source voltage VBB. However, in the constant voltage device 1 illustrated in FIG. 1, an upper limit of the voltage input to the BGR circuit U2 is limited to the output voltage VCC. Accordingly, the BGR circuit U2 of the constant voltage device 1 may accordingly have a lower voltage withstand performance than the BGR circuit U2 of the constant voltage device 100.

Diode D1 Configuration

Although there are no limitations to the configuration of the diode D1 employed in the constant voltage device 1, the diode D1 may, for example, be configured employing an NMOS transistor Tr3 formed on a p-type Silicon On Insulator (SOI) substrate with a trench-isolation structure.

Figure 3:
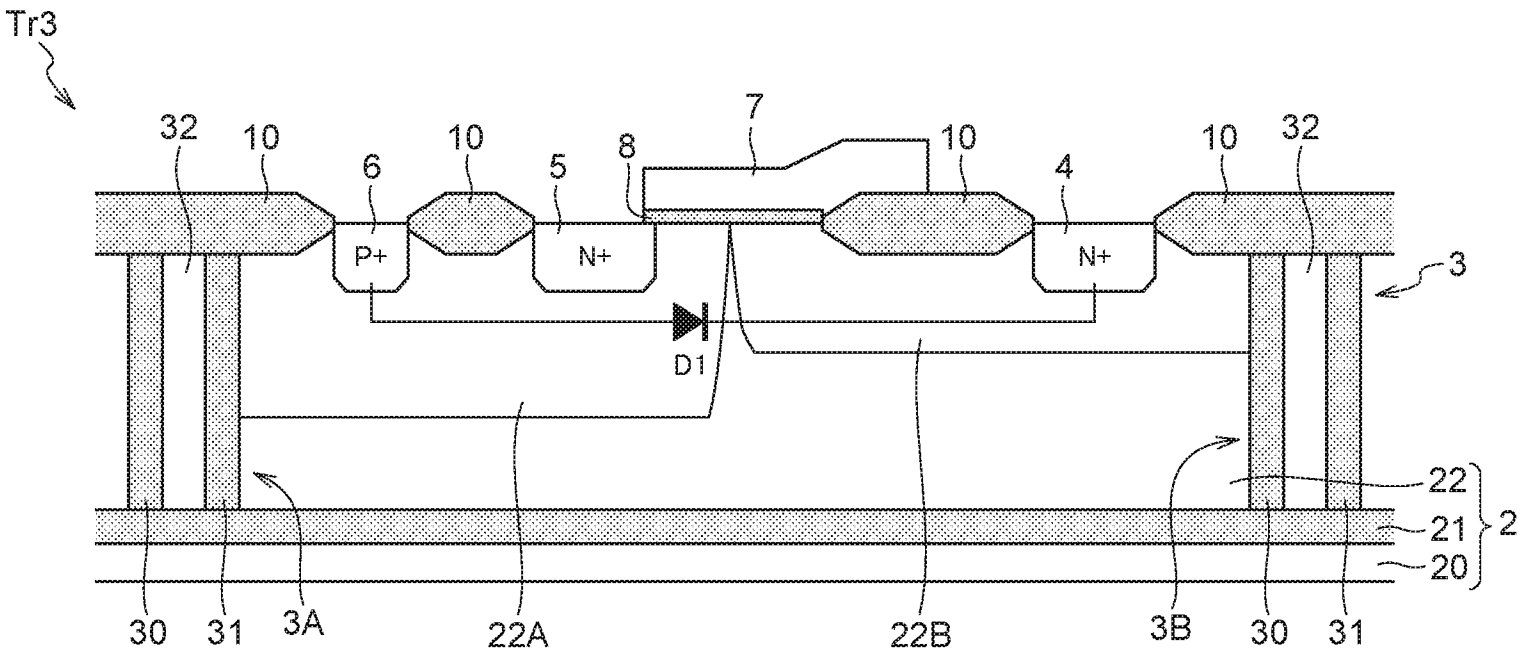
FIG. 3 is a cross-section illustrating an example of a structure of an NMOS transistor employed as a diode.

FIG. 3 is a cross-section illustrating an example of a structure of an NMOS transistor Tr3 for use as the diode D1. The cross-section illustrated in FIG. 3 schematically illustrates an example of a configuration of relevant portions of the NMOS transistor Tr3.

The NMOS transistor Tr3 is principally configured by a substrate 2. An SOI substrate is employed for the substrate 2. Namely, the substrate 2 has a layered structure configured by sequential layers of an electrically conductive support substrate 20, an insulation layer 21 formed on the support substrate 20, and an active layer 22 formed on the insulation layer 21.

The support substrate 20 may, for example, be formed from a monocrystalline silicon substrate set to p-type with a low impurity concentration. The support substrate 20 may also be set to p-type with a medium impurity concentration or with a high impurity concentration.

The insulation layer 21 is formed by a Buried Oxide (BOX) layer, and is more specifically formed by a silicon oxide layer. The insulation layer 21 is, for example, formed by injecting oxygen into the interior of the support substrate 20 using an ion injection method so as to cause local oxidization of the silicon in the interior of the support substrate 20.

The active layer 22 is, for example, formed by a monocrystalline silicon layer similarly to the support substrate 20, and is set to a p-type with a low impurity concentration. The active layer 22 is formed using part of a surface layer of the support substrate 20, and as a result of forming the insulation layer 21 is electrically isolated from the support substrate 20, with the insulation layer 21 acting as a boundary.

The NMOS transistor Tr3 is, for example, formed in the active layer 22. Specifically, a P well 22A and an N well 22B are formed in the active layer 22. An n-type semiconductor region 4 for connecting the drain terminal to is formed in the N well 22B. An n-type semiconductor region 5 for connecting the source terminal to is formed in the P well 22A. A p-type semiconductor region 6 for connecting a back gate terminal to is also formed in the P well 22A.

The n-type semiconductor regions 4, 5 and the N well are formed by using an ion injection method or a solid-phase dispersion method to introduce an n-type impurity into the interior through the surface of the active layer 22 and activating the n-type impurity. Similarly to the n-type semiconductor regions 4, 5 and the N well, the p-type semiconductor region 6 and the P well are also formed by using an ion injection method or a solid-phase dispersion method to introduce a p-type impurity into the interior through the surface of the active layer 22.

Note that the impurity concentration of the n-type semiconductor region 4 is set higher than the impurity concentration of the N well 22B, and the impurity concentrations of the n-type semiconductor region 5 and the p-type semiconductor region 6 are also set higher than the impurity concentration of the P well 22A.

A passivation film 10 is layered over the active layer 22 configured in this manner. The passivation film 10 functions as an insulator, and is, for example, formed of a single layer of a silicon oxide film or a silicon nitride film, or as a composite film including stacked layers thereof. Note that the passivation film 10 over the n-type semiconductor regions 4, 5 and the p-type semiconductor region 6 is removed from by an anisotropic etching technique, such as reactive ion etching for example, so that the passivation film 10 does not cover the n-type semiconductor regions 4, 5 and the p-type semiconductor region 6.

The passivation film 10 formed on the active layer 22 at a position corresponding to a boundary between the P well 22A and the N well 22B is referred to as a gate oxide film 8. A gate electrode 7 is formed on the gate oxide film 8.

Isolation regions 3 are formed in the active layer 22 having the NMOS transistor Tr3 formed therein. The isolation regions 3 isolate the NMOS transistor Tr3 from other elements in order to eliminate electrical effects on operation from the other elements formed in the same active layer 22. Such other elements include the PMOS transistors Tr1, Tr2, the differential amplifier AMP, and elements configuring circuits such as the BGR circuit U2. Namely, the constant voltage device 1 is modularized as a semiconductor chip by forming the elements configuring the constant voltage device 1 on the substrate 2.

In the example of the NMOS transistor Tr3 illustrated in FIG. 3, a first isolation region 3A and a second isolation region 3B are formed in the active layer 22. Hereafter, the terms first isolation region 3A and second isolation region 3B will be used when distinguishing between the individual isolation regions 3 in the explanation, whereas the collective term "isolation regions 3" will be used when not distinguishing between the individual isolation regions 3 in the explanation.

The isolation regions 3 are each configured including a trench 30, an insulator 31, and a conductor 32, and have what is referred to as a trench-isolation structure. Namely, the isolation regions 3 are formed so as to isolate the active layer 22 between the passivation film 10 and the insulation layer 21.

Each of the trenches 30 is set so as to have a width that is shorter than a length in a height direction of the NMOS transistor Tr3. Adopting such a configuration reduces the area occupied by the isolation regions 3 on the surface of the active layer 22, thereby enabling the integration density of elements on the substrate 2 to be raised. The trenches 30 are formed during the NMOS transistor Tr3 manufacturing process using an anisotropic etching technique such as reactive ion etching.

The insulator 31 is disposed on sidewalls of the trench 30. The insulator 31 is, for example, formed of a silicon oxide film, and such a silicon oxide film is formed using a chemical vapor deposition (CVD) method, for example.

The conductor 32 is buried inside the trench 30, with the insulator 31 interposed therebetween. A polycrystalline silicon film is, for example, used as the conductor 32. Impurities are introduced into the polycrystalline silicon film such that the polycrystalline silicon film is adjusted to a low resistance value.

In this manner, a periphery of the NMOS transistor Tr3 formed in the active layer 22 is surrounded by the insulation layer 21, by the isolation regions 3, and by the passivation film 10, so as to be electrically insulated from other elements.

In the NMOS transistor Tr3, the diode D1 is formed by a p-n junction formed by the N well 22B including the n-type semiconductor region 4 for connecting the drain terminal to, and the active layer 22 including the p-type semiconductor region 6 for connecting the back gate terminal to. Accordingly, the NMOS transistor Tr3 functions as the diode D1 by the back gate terminal and the drain terminal of the NMOS transistor Tr3 being respectively connected to the drain terminal of the PMOS transistor Tr2 and to the non-inverting input terminal of the differential amplifier AMP.

Note that were the diode D1 to be configured by a PMOS transistor, setting the back gate terminal of the PMOS transistor to a voltage other than the ground potential would result in a leak current flowing in the PMOS transistor. Accordingly, the MOS transistor configuring the diode D1 is preferably n-type.

Moreover, even if a voltage different to the ground potential were to be applied to the back gate terminal of the NMOS transistor Tr3, the NMOS transistor Tr3 in the substrate 2 is electrically insulated from other elements and so does not electrically effect the other elements. This enables a voltage other than the ground potential to be applied to the back gate terminal of the NMOS transistor Tr3, thereby enabling the NMOS transistor Tr3 to be employed as the diode D1. A diode D1 when provided as a discrete component would have a greater power loss than the diode D1 configured by utilizing the NMOS transistor Tr3. Employing the NMOS transistor Tr3 as the diode D1 accordingly enables the efficiency of the constant voltage device 1 to be improved.

Although the present disclosure has been explained by way of the exemplary embodiment, the present disclosure is not limited by the scope of the exemplary embodiment. Various modifications and improvements may be applied to the exemplary embodiment within a range not departing from the spirit of the present disclosure, and embodiments including any such modifications and improvements are encompassed within the technical scope of the present disclosure.

What is claimed is:

1. A constant voltage device comprising:

a diode;

a switch including one terminal connected to a ground potential and another terminal connected both to an anode terminal of the diode and to a drain of a PMOS transistor having a source applied with a power source voltage;

a voltage generation circuit configured to generate a voltage of a predetermined magnitude; and a differential amplifier that includes a non-inverting input terminal to which both a cathode terminal of the diode and an output terminal of the voltage generation circuit are connected, and that is configured to change a supply route of a reference voltage applied to the non-inverting input terminal according to a state of the switch, wherein the voltage generation circuit is configured to employ an output voltage based on the reference voltage and amplified by the differential amplifier to generate the reference voltage.

2. The constant voltage device of claim 1, wherein the diode is configured by a p-n junction between a back gate terminal and a drain terminal of an NMOS transistor formed in an active layer present on a support substrate with an insulation layer interposed between the active layer and the support substrate.

3. The constant, voltage device of claim 2, wherein a periphery of the NMOS transistor is surrounded by an insulator so as to electrically insulate the diode from another element formed in the active layer.

4. The constant voltage device of claim 1, further comprising a control circuit configured to control the switch such that:

in cases in which the output voltage is below a prescribed voltage, the switch is controlled such that the reference voltage is supplied to the non-inverting input terminal of the differential amplifier both from the diode and from the voltage generation circuit; and in cases in which the output voltage has reached the prescribed voltage or greater, the switch is controlled such that the reference voltage is supplied to the non-inverting input terminal of the differential amplifier from the voltage generation circuit.

* * * * *